US005758805A

United States Patent [19]

Dunn

[11] Patent Number: 5,758,805

[45] Date of Patent: Jun. 2, 1998

[54] ATHLETIC GLOVE POCKET-FORMING AND SHAPING DEVICE

[76] Inventor: William B. Dunn, 1034 Mary St., El Cajon, Calif. 92021

[21] Appl. No.: 755,103

[22] Filed: Nov. 22, 1996

[51] Int. Cl.[6] ..... A41D 1/00

[52] U.S. Cl. ..... 223/78; 2/19

[58] Field of Search ..... 223/78; 2/19, 16, 2/159, 160, 161.1

[56] References Cited

U.S. PATENT DOCUMENTS

| | | | |
|---|---|---|---|
| 4,190,902 | 3/1980 | Rhee | 2/16 |
| 4,373,213 | 2/1983 | Erlandson | 2/16 |
| 4,418,849 | 12/1983 | Santa | 223/78 |
| 4,765,519 | 8/1988 | Groves | 223/78 |
| 4,958,729 | 9/1990 | Wright | 223/78 |
| 5,000,317 | 3/1991 | Cich | 206/315 |
| 5,214,798 | 6/1993 | McLaughlin | 2/19 |
| 5,267,677 | 12/1993 | Nash | 223/78 |
| 5,417,647 | 5/1995 | Down | 2/16 |
| 5,456,390 | 10/1995 | McFarland | 223/78 |

*Primary Examiner*—Bibhu Mohanty
*Attorney, Agent, or Firm*—Henri J.A. Charmasson; John D. Buchaca

[57] ABSTRACT

A strapping assembly comprising a pair of parallel straps cross-connected at their ends is wrapped around a baseball glove enfolded around a ball in order to shape a pocket in the palm of the glove for more accurate catching and more secure holding of the ball.

5 Claims, 1 Drawing Sheet

ATHLETIC GLOVE POCKET-FORMING AND SHAPING DEVICE

FIELD OF THE INVENTION

The present invention relates to sporting goods and more specifically to athletic gloves used for catching a ball such as a baseball glove.

BACKGROUND OF THE INVENTION

In order for an athletic glove to receive and hold a ball securely, the palm of the glove must be shaped for a mating engagement with the ball. Players commonly shape their gloves by placing a ball inside it, folding the glove around the ball and wrapping a belt, rope or other restraining device tightly around the glove. A ball and strap assembly for that purpose is disclosed in U.S. Pat. No. 4,765,519 Groves. However, the pair of narrow straps of that invention are not sufficient to carefully shape the glove around the ball. A similar, but improved device using a wider strap is disclosed in U.S. Pat. No. 5,456,390 McFarland. In those two examples of the prior art as well as in other prior attempts to provide a convenient and effective glove-forming device, the restraint imposed to the outside of the glove is generally cylindrical and do not provide a cupping restraint that would force the top and bottom sections of the glove to more accurately close around the ball.

This invention results from attempts to develop a simple, yet more incurvating type of wrapping strap more efficiently adapted to the shaping of a baseball glove.

SUMMARY OF THE INVENTION

The principal and secondary objects of this invention are to provide a simple, small, lightweight pattern of straps particularly adapted to hold a baseball glove tightly cupped around a baseball of softball in order to form within the palm of said glove a convenient and secure catching pocket.

These and other valuable objects are achieved by a pair of straps made from an elastomeric material which are held parallel and spaced apart by their central section and yet can be wrapped in a cross-over and adjustable arrangement around a baseball or softball glove in order to form a near spherical constraining cage.

DESCRIPTION OF THE PREFERRED EMBODIMENT OF THE INVENTION

Figure 1:
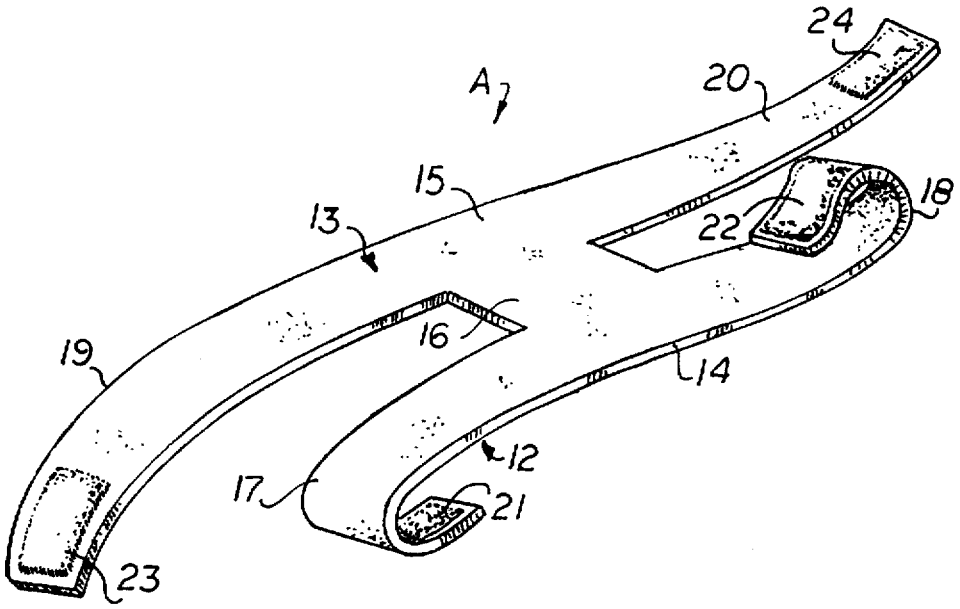
FIG. 1 is a perspective view of the athletic glove-forming device according to the invention.
Figure 2:
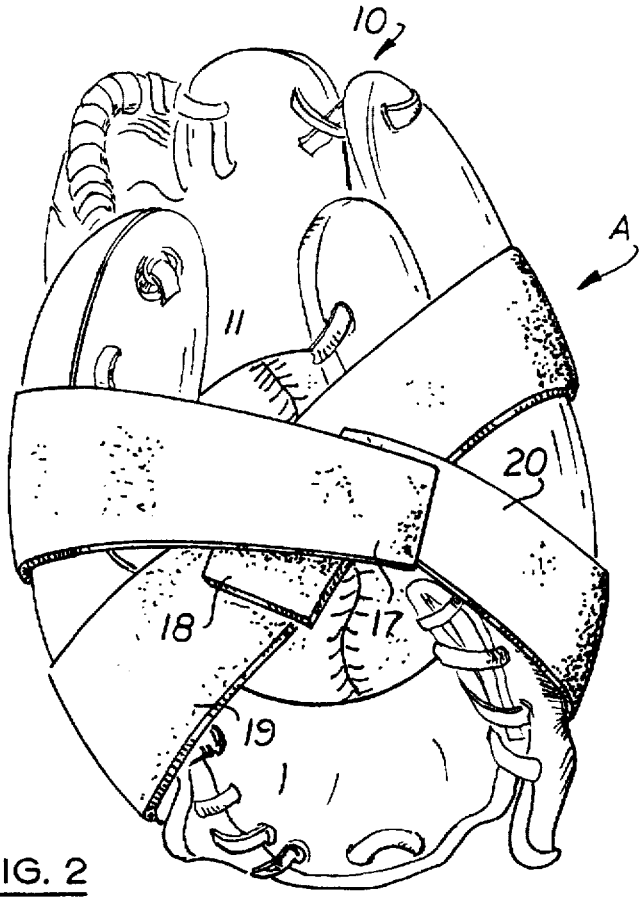
FIG. 2 is a perspective view of the device shown applied to a baseball glove.

Referring now to the drawing, there is shown a glove-shaping device A specifically designed to wrap around a baseball glove 10 enfolded around a baseball 11. The device comprises two resiliently stretchable elongated straps 12, 13 integrally joined and parallelly held apart about their central sections 14, 15 by a bridge 16. Each strap thus comprises two opposite strips 17, 18 and 19, 20 extending in opposite directions from the central sections 14, 15. Patches of mating hook-and-vane cloth fasteners 21, 22, 23 and 24 are bonded or attached to the end portions of each strip in such a manner that a fastener patch 21 installed on the inner surface at the end of a strip 17 in strap 14 can be secured to a mating fastener patch 24 on the outer surface of an opposite strip 20 of the other strap 15; Similarly, the ends of the opposite remaining strips 18 and 19 carrying mating cloth fastener patches 22 and 23 on opposite surfaces can be tied together Once the glove 10 has been tightly enfolded around the ball 11 the central part 16 of the glove-shaping device is applied against the back of the glove, and the straps are pulled tightly around the glove and ball, then crossed-tied together as illustrated in FIG. 2. In other words, the end of the first strip 17 of the first strap 12 is secured to the end of the first and opposite strip 20 of the second strap 13, while the end of the second strip 18 of the first strap 12 is secured to the end of the second and opposite strip 19 of the second strap 13. It should be noticed that this cross-tying creates a near-spherical constraint around the glove causing the upper and lower part of the glove to close in tightly around the ball.

The glove-shaping device is preferably cut or stamped out of a sheet of elastomeric material such as neoprene. Its overall length is approximately fifty centimeters (20 inches). The width at its middle is about seventeen centimeters (7 inches). The spacing between the straps is about five centimeters (2 inches). The length of the bridging section 16 is about 7 centimeters (3 inches).

While the preferred embodiment of the invention has been described, modifications can be made and other embodiments may be devised without departing from the spirit of the invention and the scope of the appended claims.

What is claimed is:

1. The combination of an athletic glove for use in catching a ball with a glove-shaping device wherein said device comprises first and second straps, each having a central portion and first and second opposite strips astride said central portion;

a bridging third strap;

said first and second straps being joined and parallelly held apart by said third strap about their central portions;

releasable means for securing opposite strip end portions of said first and second straps to one another; and said straps being shaped and dimensioned to wrap around and hold said glove tightly enfolded around said ball.

2. The combination of claim 1, wherein said straps are made of elastomeric resiliently stretchable material.

3. The combination of claim 2, wherein said straps are held in a substantially parallel and spaced-apart configuration by said central portion.

4. The combination of claim 3, wherein said means for securing comprise:

means for releasably securing an end portion of a first strip of the first strap to an end section of an opposite first strip of the second strap; and means for releasably securing an end portion of a second strip of the first strap to an end section of an opposite second strip of the first strap.

5. The combination of claim 4, wherein said means for releasably securing further comprises cooperating patches of hook-and-vane cloth fasteners bonded to said strip ends.

* * * * *